US008783162B2

(12) United States Patent
Raunisto

(10) Patent No.: US 8,783,162 B2
(45) Date of Patent: Jul. 22, 2014

(54) HYDRAULIC DRIVEN TURNING DEVICE

(75) Inventor: Yrjo Raunisto, Hameenlinna (FI)

(73) Assignee: Kinshofer GmbH, Waakirchen (DE)

( * ) Notice: Subject to any disclaimer, the term of this patent is extended or adjusted under 35 U.S.C. 154(b) by 1012 days.

(21) Appl. No.: 12/735,694

(22) PCT Filed: Feb. 9, 2009

(86) PCT No.: PCT/FI2009/000023

§ 371 (c)(1),
(2), (4) Date: Oct. 22, 2010

(87) PCT Pub. No.: WO2009/098351

PCT Pub. Date: Aug. 13, 2009

(65) Prior Publication Data

US 2011/0030550 A1 Feb. 10, 2011

(30) Foreign Application Priority Data

Feb. 8, 2008 (FI) ..... 20080090

(51) Int. Cl.
*F01B 3/00* (2006.01)
*F15B 15/20* (2006.01)

(52) U.S. Cl.
USPC ..... 92/31; 92/165 PR

(58) Field of Classification Search
USPC ..... 92/31, 32, 33, 136, 165 PR
See application file for complete search history.

(56) References Cited

U.S. PATENT DOCUMENTS

| | | | |
|---|---|---|---|
| 4,015,728 | A | 4/1977 | Barker et al. |
| 4,603,616 | A | 8/1986 | Zajac |
| 7,028,602 | B2 | 4/2006 | Breuer et al. |

FOREIGN PATENT DOCUMENTS

| | | | |
|---|---|---|---|
| DE | 198 15 008 | A1 | 10/1999 |
| WO | WO 03/072955 | A1 | 9/2003 |

*Primary Examiner* — Michael Leslie
(74) *Attorney, Agent, or Firm* — Jacobson Holman, PLLC.

(57) ABSTRACT

A hydraulic driven turning device to be installed to a construction machine has a first body and a second body turning in relation to the first body, and a hydraulic cylinder attached from the first and second bodies to another body. A piston is axially movable via a hydraulic pressure medium, and a spiral part is attached to the piston. The spiral part causes a rotational movement to a counter part equipped with a spiral, whereupon the rotational movement can be transferred to be a turning movement of another body. The piston is arranged to be non-rotating in the cylinder by forming the cross section of the piston and the cylinder to be deviant from a round form, such as having an oval or angular shape, or by adjusting the piston to be eccentric in relation to a bearing axis thereof.

9 Claims, 2 Drawing Sheets

A—A

HYDRAULIC DRIVEN TURNING DEVICE

CROSS-REFERENCE TO RELATED APPLICATIONS

This is a national stage of PCT/FI09/000023 filed Feb. 9, 2009 and published in English, which has a priority of Finland no. 20080090 filed Feb. 8, 2008, hereby incorporated by reference.

BACKGROUND OF THE INVENTION

1. Field of Invention

Invention relates to a hydraulic driven turning device that can be installed to a construction machine, such as at the end of a boom of a power shovel whereupon a first body and another body, which is turning in relation to it, belong to the turning device and a hydraulic cylinder, which is attached from the mentioned bodies to one body, belong to the device in which cylinder the piston that is located in there can be moved axially back and forth with the help of a hydraulic pressure medium and a spiral part is attached to the piston that causes a rotation movement to its counter part that is equipped with a spiral whereupon the mentioned rotation movement can be transferred to be the turning movement of another body.

2. Description of the Prior Art

Hydraulic driven turning devices according to the above mentioned introduction are previously known in which devices ring piston, which can be moved back and forth with the help of a hydraulic pressure, is installed on top of a axis to be directed in axial direction in such a way that there is a spiral with large pitch between them whereupon a rotation movement is created between them when only another one of them can move in axial direction. Further there is a spiral with large pitch at the outer surface of the ring piston which spiral co-operates with the spiral of the barrel that is outside it. The movement of the mentioned barrel is locked in axial direction whereupon it rotates in relation to the piston if the piston is being moved. The another body of the turning device is attached non rotating to the mentioned barrel and another body is attached to the mentioned axis to be non rotating and the axial movement of the piston makes then the bodies to turn with each other.

This kind of known turning device is expensive to manufacture because spirals, which can be manufactured on four different surfaces in a relatively difficult way, belong to it. In these solutions ring piston is used as a piston whereupon its diameter has to be measured to be larger than a disc-like piston when its power-creating surface area! can be achieved only from the ring part. Also in these known solutions, parts that can be moved and are to be sealed are used a lot.

SUMMARY OF THE INVENTION

In order to remove the disadvantages of the known solution described above a new turning device, which is essentially easier to manufacture, which needs less screwed parts and the structural diameter of which can be made smaller than in known turning devices, has been developed. It is characteristic of the turning device according to the invention that the piston is arranged to be non rotating in the cylinder located in the body by forming the cross-section of the piston and cylinder to be deviant from a round form, such as to be a oval or a angular or by adjusting the piston eccentric in relation to its bearing axis.

The advantage of the arrangement according to the invention is the fact that only one threaded coupling is needed at the turning device and due to that only two screwed counter surfaces are needed. Pressurised hydraulic device must be sealed only at three sliding surfaces at its simplest of which one is sliding and two other are rotating. Due to the spiral with large pitch the turning device can also be organized to be self-locking with the help of some angle of ascents of the spiral, in other words by directing turning power to another body of the turning device, the piston cannot be moved in axial direction in the cylinder. The load of the body of the turning device can easily be reduced by making the piston rod to extend on both sides of the piston and in this way spiral parts can be made to load the body of the device in a symmetrical way. Also the combined length of the spiral parts that produce turning power stays the same all the time regarding all the rotating angles of the device.

BRIEF DESCRIPTION OF THE DRAWINGS

In the following the invention is described more detailed by referring to the accompanying drawing in which.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art. from this detailed description.

Figure 1:
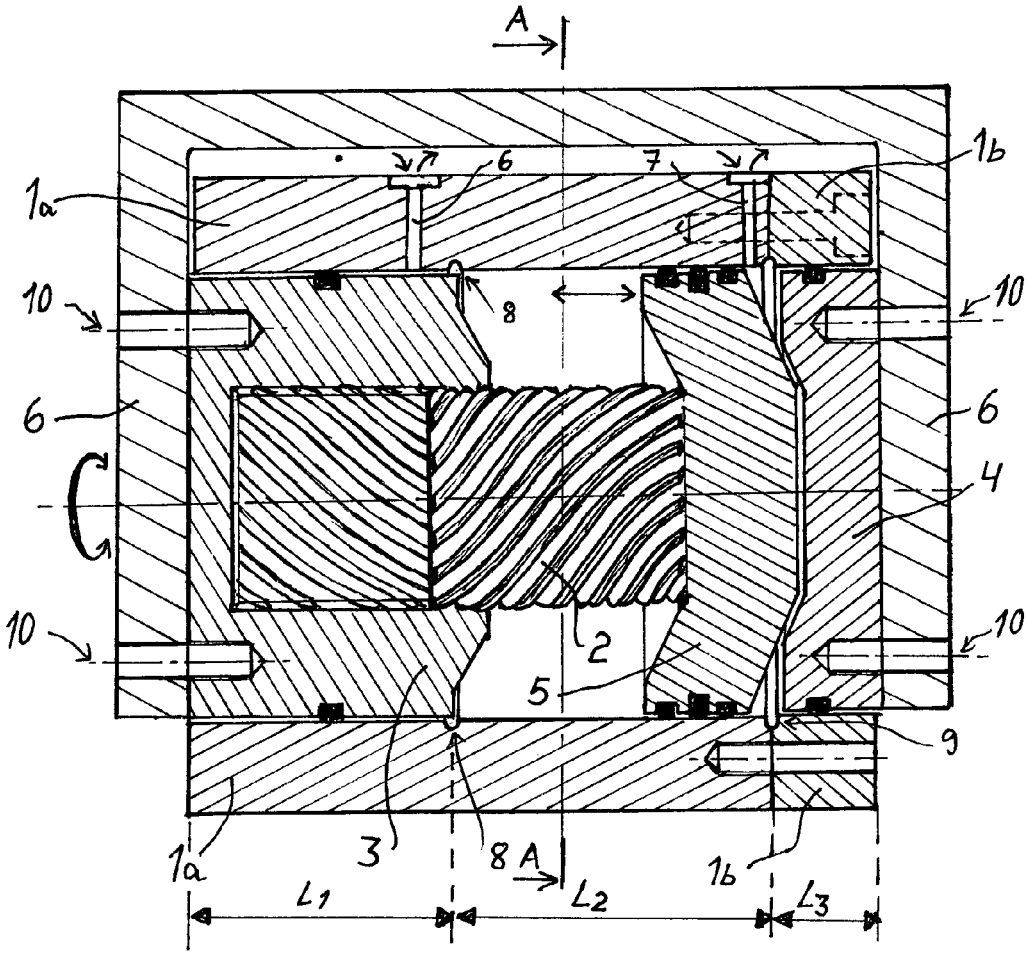
FIG. 1 shows a turning device according to the invention as a section view in direction of the longitudinal axis.

A turning device according to the invention is shown in the FIG. 1 in which turning device the first body, a cylindrical part 1 and another body, a saddle-like part 6 can be turned in relation to each other in such a way that another body 6 turns around the centre axis of the first body 1 shown in the FIG. 1. Body 1 comprises a cylindrical cylinder part to which a longer part 1*a* with a length of L1+L2 and an end part 1*b* attached to be the extension of it the length of which is L3, belong. The cylinder 1 has a round inner part regarding the part L1 in this described embodiment, has an elliptical—in other words oval form regarding the part L2 and again a round form regarding the part L3. Regarding the part L3 the roundness is formed with the help of a separate ring piece 1*b* that is attached to the end of the cylinder part. The installation of the oval piston 5 inside the cylinder is thus possible through this opened end. Regarding the part L1 the roundness of the inner surface to the part 1*a* has been made by lathing or by broadening. Regarding the part L2 oval form on the inner surface is made with the help of a computer-controlled machining. There is a groove 8 at the border part where the round form becomes an oval form. Regarding the oval part L2 of the cylinder an oval piston 5 moves with the help of hydraulic pressure which pressure is directed to various sides of the piston 5 from the channels 6 and 7. A piston 5 with an oval cross section is sealed to the oval inner surface of the cylinder with a method known as such. Thus the piston 5 cannot rotate in the cylinder 1*a*.

Also a spiral part 2 belongs fixed to the piston 5 which spiral part 2 rotates the piece 3 that exists in the round part of the cylinder 1*a* while the piston 5 is being moved. The spiral part 2 has a large pitch, for example the Helicoil-spiral known in the art. The rotation of the piece 3 turns at the same time the another body 6 which is attached to it with the help of bolts, for example through holes 10 which body thus turns in relation to the first body 1. Conventional attaching elements not shown belong to the bodies 1 and 6 with which attaching elements for example the first body 1 is attached to the end of the boom of the power shovel and a tool, like a grab, is attached to another body 6.

In one embodiment the whole cylinder part 1*a*+1*b* machined to be elliptical at its inner surface. In that case disc-like modification pieces 11 FIG. 3 have to be made to the both ends of the cylinder part that correspond to! the oval inner surface of the cylinder 1 at their outer surface and that modification pieces have a hole in the centre to which hole round attaching collar according to the part 4 of the FIG. 1 can be adjusted to be rotating. An oval cylinder part is reserved for the mid-part in the cylinder for the piston 5. In the FIG. 1 the piston 5 is cut along the line of the smaller diameter of the ellipse form of the piston.

In another embodiment round parts regarding their inner surfaces are adjusted to the ends of the cylinder 1 to both ends according to the right end of the cylinder 1 shown in the FIG. 1. At this case separate ring pieces, like 1*b* that have an oval outer surface and that have a round inner hole in order to adjust the parts 4 and 3 to them, are attached to the ends of the cylinder 1.

Figure 4:
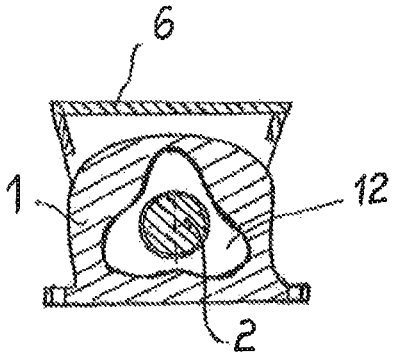
FIG. 4 shows a triangular piston in a cylinder part with a similar form.

In one embodiment the inner surface of the cylinder is angular, like triangular 12, FIG. 4 or quadrangular at least in the area of the course of the piston and correspondingly the piston has the same form at its outer surface. When the outward appearance of the piston is rounded at its edges, it is still easy to equip reliably with a sealing that is around the circle.

Figure 2:
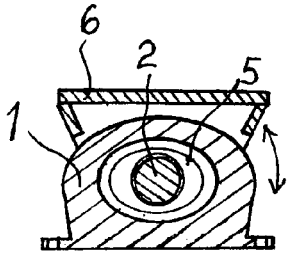
FIG. 2 shows the cross-section of the turning device as a section view at the location of the piston along the line A-A when another turning body has been removed.

The cross section of the turning device of the figure is shown as reduced in the FIG. 2 regarding the line A-A which line cuts the cylinder 1 at that point where there is an elliptical form.

Figure 3:
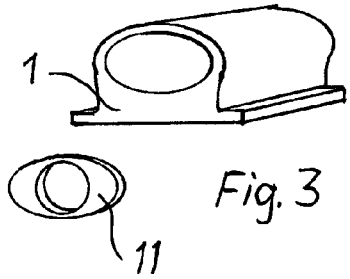
FIG. 3 shows one modification piece and the body of the device

Body 1 is shown in the FIG. 3 in which body there is an oval, for example an elliptical hole regarding the whole length. The modification piece 11 is adjusted to the both ends of the body 1 whereupon round holes for the parts 3 and 4 can be organized to the ends. The thickness of the part 11 is selected according to the needs. The part 11 can easily be bolt fixed to the body 1 through the spiral holes that lead from the surface of the body to the part 11. The modification piece 11 can be installed for example only to the other end of the body 1 whereupon at the other end the elliptical form finishes before the end of the body 1 in such a way that a round hole has been able to lathe to this end.

Figure 5:
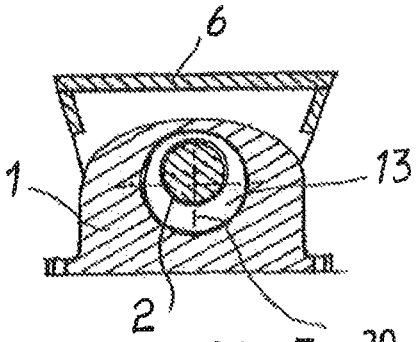
FIG. 5 shows a round piston located eccentric in relation to its bearing axis.

A round piston 13 is shown in the FIG. 5 being adjusted eccentric inside the body 1 in such a way that the centre of the round piston 13 is located eccentric in relation to the centre of the bearing axis 20 of the round piston 13. Also in that case the rotation of the piston 13 is prohibited in the cylinder even though the piston 13 is round.

Figure 6:
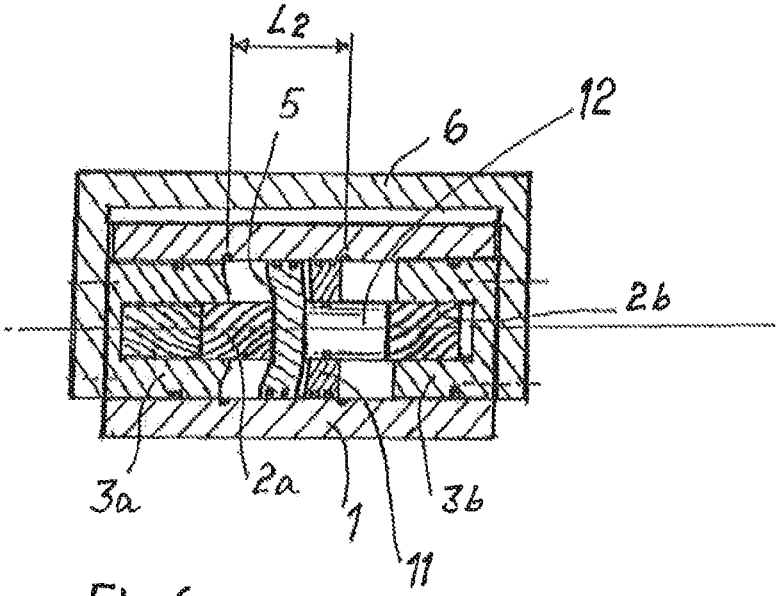
FIG. 6 shows a turning device in which the piston rod extends to the both sides of the piston.

In the FIG. 6 a modified version of the solution of the FIG. 1 is shown in which version the piston rod extends also to another side of the piston 5 comprising the spirals 2*a* and correspondingly 2*b*. Also the Helicoil-spirals 2*a* and 2*b* have counter parts 3*a* and 3*b* with corresponding spirals which pieces 3*a* and 3*b* start to turn when the piston is being pushed.

The pieces 3*a* and 3*b* convey the rotation movement directly to the body 6. The cylinder 1 has a part L2 that deviates from a round form. This part also has a non rotating and non moving insertion ring 11. The piston rod is even at the location of the mentioned ring 11 and the piston rod slides in the hole of the ring 11 which hole is equipped with a sealing when the piston 5 moves in axial direction. In this case the body 6 gets loaded in a symmetrical way and the spiral length producing rotating power for the Helicoil-spiral stays stable regarding all turning angles of the device.

Figure 7:
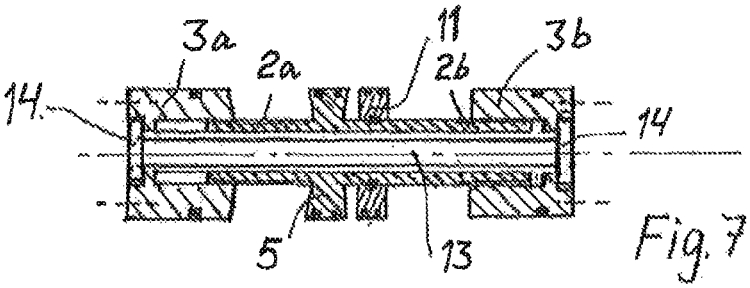
FIG. 7 shows a draw bar that is adjusted inside the piston rod.

In the FIG. 7 draw bar 13 connected to the solution of the FIG. 6 is shown which draw bar receives the forces that push both pieces 3*a*, 3*b* outwards during the rotation movement. The draw bar 13 is placed inside a hollow piston rod. There are flanges 14 at the ends of the draw bar 13 which flanges prohibit the pieces 3*a*, 3*b* from moving further from each other. The pieces 3*a*, 3*b* rotate in the same direction so that the flanges 14 can be locked for example with screws to the pieces 3*a*, 3*b*.

The invention being thus described, it will be apparent that the same way be varied in many ways. Such variations are not to be regarded as a departure from the spirit and scope of the invention, and all such modifications as would be recognized by one skilled in the art are intended to be included within the scope of the following claims.

What is claimed is:

1. A hydraulic driven turning device to be installed to a construction machine, comprising a first body, a second body turning in relation to the first body, a hydraulic cylinder attached from the first body and the second body to another body, a piston that is axially movable back and forth in the hydraulic cylinder via a hydraulic pressure medium, and a spiral part that is attached to the piston, the spiral part causing a rotational movement that can be transferred to be a turning movement of the another body, the piston being arranged to be non-rotating in the hydraulic cylinder by forming a cross section of the piston and the hydraulic cylinder to be deviant from a round form, and the hydraulic cylinder only having a part L2 in relation to the spiral part that is deviant from the round form or is eccentric located regarding a cross section thereof, the part L2 being the course of the piston.

2. The turning device according to claim 1, wherein the piston is triangular or quadrangular, and has rounded edges.

3. The hydraulic driven turning device according to claim 1, wherein the turning device is located at an end of a boom of a power shovel.

4. The hydraulic driven turning device according to claim 1, wherein the cross section of the piston and the cylinder has an oval or an angular shape.

5. The hydraulic driven turning device according to claim 1, wherein the piston is adjusted to be eccentric in relation to a bearing axis thereof.

6. A hydraulic driven turning device to be installed to a construction machine, comprising a first body, a second body turning in relation to the first body, a hydraulic cylinder attached from the first body and the second body to another body, a piston that is axially movable back and forth in the hydraulic cylinder via a hydraulic pressure medium, and a spiral part that is attached to the piston, the spiral part causing a rotational movement that can be transferred to be a turning movement of the another body, the piston being arranged to be non-rotating in the hydraulic cylinder by forming a cross section of the piston and the hydraulic cylinder to be deviant from a round form, and a part L2 of the hydraulic cylinder that differs from the round form regarding the cross section being located in a middle portion of the hydraulic cylinder with respect to a longitudinal direction of the hydraulic cylinder.

7. A hydraulic driven turning device to be installed to a construction machine, comprising a first body, a second body turning in relation to the first body, a hydraulic cylinder attached from the first body and the second body to another body, a piston that is axially movable back and forth in the hydraulic cylinder via a hydraulic pressure medium, and a spiral part that is attached to the piston, the spiral part causing a rotational movement that can be transferred to be a turning movement of the another body, the piston being arranged to be non-rotating in the hydraulic cylinder by forming a cross section of the piston and the hydraulic cylinder to be deviant from a round form, and a separate piece being attached to one or both end surfaces of the hydraulic cylinder, with an inner hole of the separate piece being round.

8. A hydraulic driven turning device to be installed to a construction machine, comprising a first body, a second body turning in relation to the first body, a hydraulic cylinder attached from the first body and the second body to another body, a piston that is axially movable back and forth in the hydraulic cylinder via a hydraulic pressure medium, and a spiral part that is attached to the piston, the spiral part causing a rotational movement that can be transferred to be a turning movement of the another body, the piston being arranged to be non-rotating in the hydraulic cylinder by forming a cross section of the piston and the hydraulic cylinder to be deviant from a round form, and a modification piece that is attached to one or both ends of the hydraulic cylinder onto an inner surface thereof, the modification piece being configured such that the inner surface of the cylinder that deviates from the round form is modified to be round.

9. A hydraulic driven turning device to be installed to a construction machine, comprising a first body, a second body turning in relation to the first body, a hydraulic cylinder attached from the first body and the second body to another body, a piston that is axially movable back and forth in the hydraulic cylinder via a hydraulic pressure medium, and a spiral part that is attached to the piston, the spiral part causing a rotational movement that can be transferred to be a turning movement of the another body, the piston being arranged to be non-rotating in the hydraulic cylinder by forming a cross section of the piston and the hydraulic cylinder to be deviant from a round form, and the spiral part being configured as a first spiral part and a second spiral part, each of which is attached to a piston rod at opposed ends thereof.

* * * * *